US007608018B2

(12) United States Patent
Chuang et al.

(10) Patent No.: US 7,608,018 B2
(45) Date of Patent: Oct. 27, 2009

(54) STATIONARY EXERCISE DEVICE

(76) Inventors: Jin Chen Chuang, No. 17, Lane 301, Nanyang Road, FONG yuan, Taichung Hsien (TW) 42083; Lung Fei Chuang, No. 17, Lane 301, Nanyang Road, Fong Yuan, Taichung Hsien (TW) 42083

( * ) Notice: Subject to any disclaimer, the term of this patent is extended or adjusted under 35 U.S.C. 154(b) by 0 days.

(21) Appl. No.: 11/797,000

(22) Filed: Apr. 30, 2007

(65) Prior Publication Data

US 2008/0269023 A1 Oct. 30, 2008

(51) Int. Cl.
*A63B 22/04* (2006.01)

(52) U.S. Cl. ..... 482/52

(58) Field of Classification Search ..... 482/51–53, 482/57, 62, 70–71, 79, 80; *A63B 22/06, A63B 22/08, 22/12*

See application file for complete search history.

(56) References Cited

U.S. PATENT DOCUMENTS

| | | | | |
|---|---|---|---|---|
| 5,290,211 | A | 3/1994 | Stearns | 482/53 |
| 5,499,956 | A | 3/1996 | Habing et al. | 482/52 |
| 5,577,985 | A | 11/1996 | Miller | 482/52 |
| 5,595,553 | A | 1/1997 | Rodgers, Jr. | 482/51 |
| 5,769,760 | A | 6/1998 | Lin et al. | 482/52 |
| 6,022,296 | A | 2/2000 | Yu | 482/52 |
| 6,045,487 | A * | 4/2000 | Miller | 482/52 |
| 6,485,395 | B1 * | 11/2002 | Stearns et al. | 482/57 |
| 6,544,146 | B1 * | 4/2003 | Stearns et al. | 482/52 |
| 6,569,061 | B2 * | 5/2003 | Stearns et al. | 482/52 |
| 7,121,984 | B1 * | 10/2006 | Hong | 482/52 |
| 7,381,158 | B2 * | 6/2008 | Girard et al. | 482/51 |

* cited by examiner

*Primary Examiner*—Loan H Thanh
*Assistant Examiner*—Oren Ginsberg
(74) *Attorney, Agent, or Firm*—Charles E. Baxley

(57) ABSTRACT

An exercise device includes two cranks rotatably coupled to a rear portion of a upright support and each having a pivot rod, two handles having a middle portion pivoted to a front portion of the upright support with a spindle, two foot supports pivotally coupled to the handles and each having a middle portion pivotally coupled to the pivot rod of the cranks with a link, the front portions of the foot supports may be controlled by the handles to allow the foot supports to be actuated as a stepping exerciser when the front portions of the foot supports are stably held in place by the handles, and to allow the foot supports to be actuated as an elliptical exerciser when the handles are swung by the user.

1 Claim, 8 Drawing Sheets

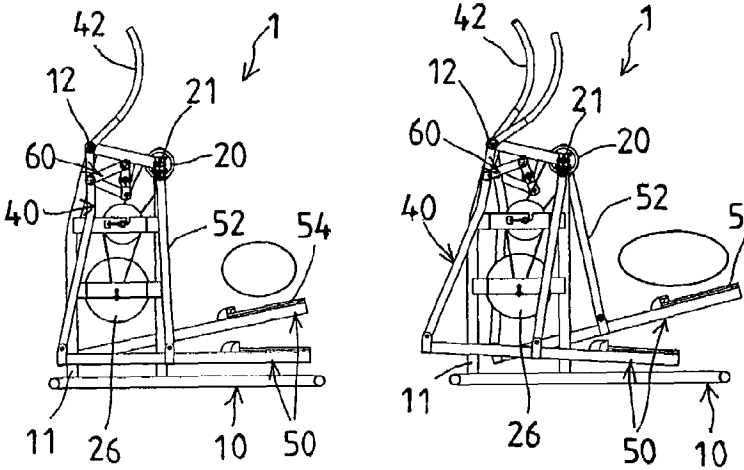
FIG. 8
FIG. 9
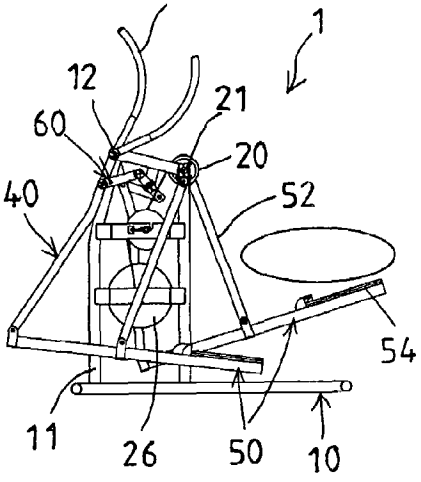
FIG. 10
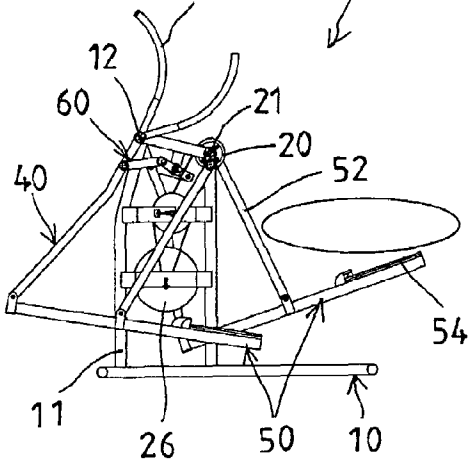
FIG. 11

STATIONARY EXERCISE DEVICE

BACKGROUND OF THE INVENTION

1. Field of the Invention

The present invention relates to a stationary exercise device, and more particularly to an elliptical exercise device including an arrangement for allowing the exercise device to have an increased or different moving stroke and/or a changing moving stroke, and for allowing the exercise device to be actuated or worked either as a stepping exerciser or an elliptical exerciser.

2. Description of the Prior Art

Typical exercise devices, such as stepping exercisers comprise a pair of handles pivotally attached to an upwardly extending frame member of a base support device, and a pair of foot supports pivotally coupled to the handles and arranged for allowing the foot supports to be stepped or moved up and down relative to the base support device.

For example, U.S. Pat. No. 5,290,211 to Stearns discloses one of the typical exercise devices also comprising a pair of handles pivotally attached to an upwardly extending frame member of a base support device, and a pair of foot supports pivotally coupled to the handles, and a pair of force resisting device pivotally coupling the foot supports to the upwardly extending frame member for allowing the foot supports to be stepped or moved up and down relative to the base support device.

However, normally, the middle portion of the foot supports is pivotally coupled to the upwardly extending frame member such that the middle portion of the foot supports is pivoted relative to the base support device but may not be moved cyclically or in reciprocating relative to the base support device, and such that the moving stroke of the typical exercise devices may not be suitably increased.

U.S. Pat. No. 5,499,956 to Habing et al. discloses a typical articulated lower body exercise device comprising a pair of foot supports pivotally coupled to the upwardly extending frame member of a base support device with a pair of vertical linkage arms, and a device for swinging the vertical linkage arms and the foot supports relative to the upwardly extending frame member of the base support device for allowing the foot supports to be stepped or moved elliptically relative to the base support device.

However, the middle portion of the foot supports is only pivoted relative to the base support device but may not be moved cyclically or in reciprocating relative to the base support device, and such that the moving stroke of the typical exercise devices may not be suitably increased.

U.S. Pat. No. 5,577,985 to Miller discloses a typical stationary exercise device comprising a pair of guide links or handles pivotally attached to an upright support, and a pair of foot supports each pivotally coupled to the handles, and a pair of cranks pivotally coupled to the handles and the foot supports with an intermediate link and a control link, for swinging the handles and the foot supports relative to the base support device and for allowing the foot supports to be stepped or moved elliptically relative to the base support device.

However, the middle portion of the foot supports is only pivotally coupled to the handles, and may not be moved cyclically or in reciprocating relative to the base support device such that the moving stroke of the typical exercise devices may not be suitably increased.

U.S. Pat. No. 5,595,553 to Rodgers, Jr. discloses another typical stationary exercise device also comprising a pair of handles pivotally attached to an upright support, and a pair of foot supports each pivotally coupled to the handles, and a pair of cranks pivotally coupled to the foot supports with a reciprocating member for swinging the handles and the foot supports relative to the base support device and for allowing the foot supports to be stepped or moved elliptically relative to the base support device.

However, similarly, the foot supports is only pivotally coupled to the handles, and may not be moved cyclically or in reciprocating relative to the base support device such that the moving stroke of the typical exercise devices may not be suitably increased or adjusted.

U.S. Pat. No. 5,769,760 to Lin et al. discloses a further typical stationary exercise device comprising a pair of foot supports including a front portion pivotally coupled to an upright support, and a pair of handles also pivotally attached to the upright support, and a pair of cranks pivotally coupled to the handles for swinging the handles and the foot supports relative to the base support device and for allowing the foot supports to be stepped or moved elliptically relative to the base support device.

However, the handles are located closer to the users, and are pivotally coupled to the upright support and may also be moved cyclically relative to the upright support of the base support device such that the handles will also be moved cyclically relative to the upright support and such that the handles may not be suitably or easily grasped and handled by the users.

U.S. Pat. No. 6,022,296 to Yu discloses a further typical stepping exercise device comprising a pair of handles pivotally coupled to an upright support with a pair of cranks, and a pair of foot supports including a middle portion pivotally attached to the base support and including a front portion pivotally coupled to the handles.

However, the foot supports are only coupled to the upright support or the base support such that the foot supports may only be stepped or moved up and down relative to the base support device, but may not be stepped or moved elliptically relative to the upright support of the base support device. The typical stepping exercise devices may not be stepped and actuated or worked either as a stepping exerciser or an elliptical exerciser.

The present invention has arisen to mitigate and/or obviate the afore-described disadvantages of the conventional elliptical exercise devices.

SUMMARY OF THE INVENTION

The primary objective of the present invention is to provide an exercise device including an arrangement for allowing the exercise device to have a different or a changing moving stroke.

The other objective of the present invention is to provide an exercise device including an arrangement for allowing the exercise device to be actuated or worked either as a stepping exerciser or an elliptical exerciser or to be convertible between a stepping exerciser and an elliptical exerciser.

In accordance with one aspect of the invention, there is provided an exercise device comprising a base including an upright support extended upwardly from the base and including a front portion and a rear portion, a spindle disposed on the front portion of the upright support, two cranks rotatably coupled to the rear portion of the upright support with a shaft, the cranks each including a pivot rod attached to the crank and spaced away from the shaft, two handles including a middle portion attached to the spindle for allowing the handles to be pivotally coupled to the front portion of the upright support with the spindle and for allowing the handles to be pivoted and swung relative to the upright support of the base, the handles each including a hand grip provided on an upper portion for being grasped or held by a user and each including a lower portion, and two foot supports each including a front portion pivotally coupled to the lower portion of the handles, and each including a foot pedal disposed on a rear portion for supporting the user's feet, and each including a middle portion pivotally coupled to the pivot rod of the cranks with a link for allowing the middle portions of the foot supports to be moved cyclically relative to the upright support of the base by the cranks, and the front portions of the foot supports may be controlled by the handles to allow the foot supports to be actuated as a stepping exerciser when the handles and the front portions of the foot supports are stably held in place by the user with the hand grips, and to allow the foot supports to be actuated as an elliptical exerciser when the handles and the front portions of the foot supports are moved or swung by the user.

A resisting device may further be provided for resisting a rotational movement of the shaft and the cranks, the resisting device includes a wheel rotatably attached to the rear portion of the upright support with the shaft. The resisting device includes a rotary member rotatably attached to the upright support with an axle and coupled to the wheel.

A follower is further be provided and attached to the axle and moved in concert with the axle, and the follower is coupled to the wheel with a coupling device. A flywheel is further be provided and rotatably attached to the upright support with a pivot rod and coupled to the rotary member with a coupling device.

A coupling device may further be provided for coupling the handles together, the coupling device includes two cranks coupled together and coupled to the handles respectively for coupling the handles together. The base includes a pivot pole disposed on the upright support and coupled to the cranks for coupling the cranks together.

Further objectives and advantages of the present invention will become apparent from a careful reading of the detailed description provided hereinbelow, with appropriate reference to the accompanying drawings.

BRIEF DESCRIPTION OF THE DRAWINGS

FIGS. 8, 9, 10, 11 are side plan schematic views similar to FIGS. 5-7, illustrating the operation of the exercise device.

DETAILED DESCRIPTION OF THE PREFERRED EMBODIMENT

Figure 1:
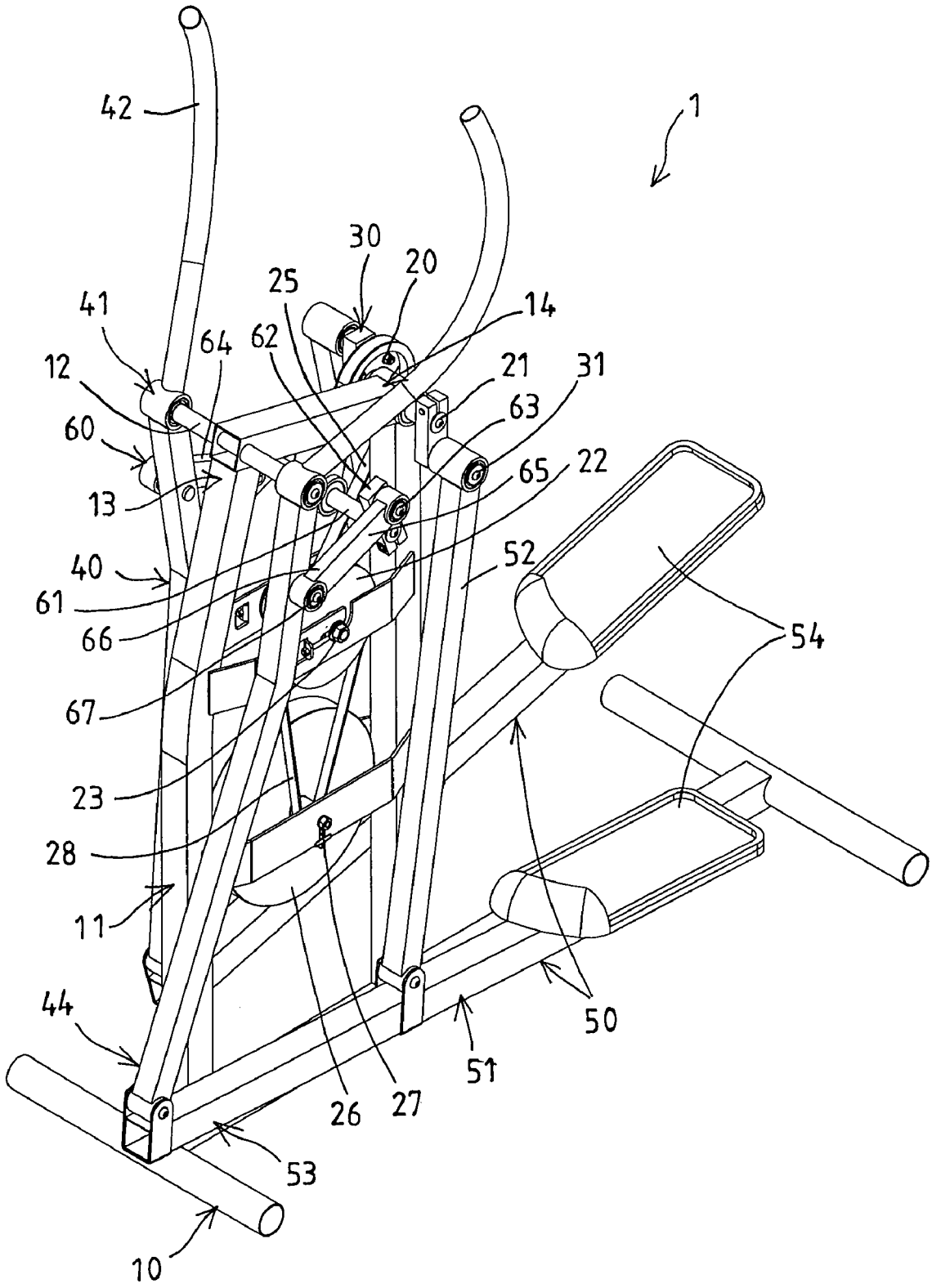
FIG. 1 is a front perspective view of an exercise device in accordance with the present invention.
Figure 2:
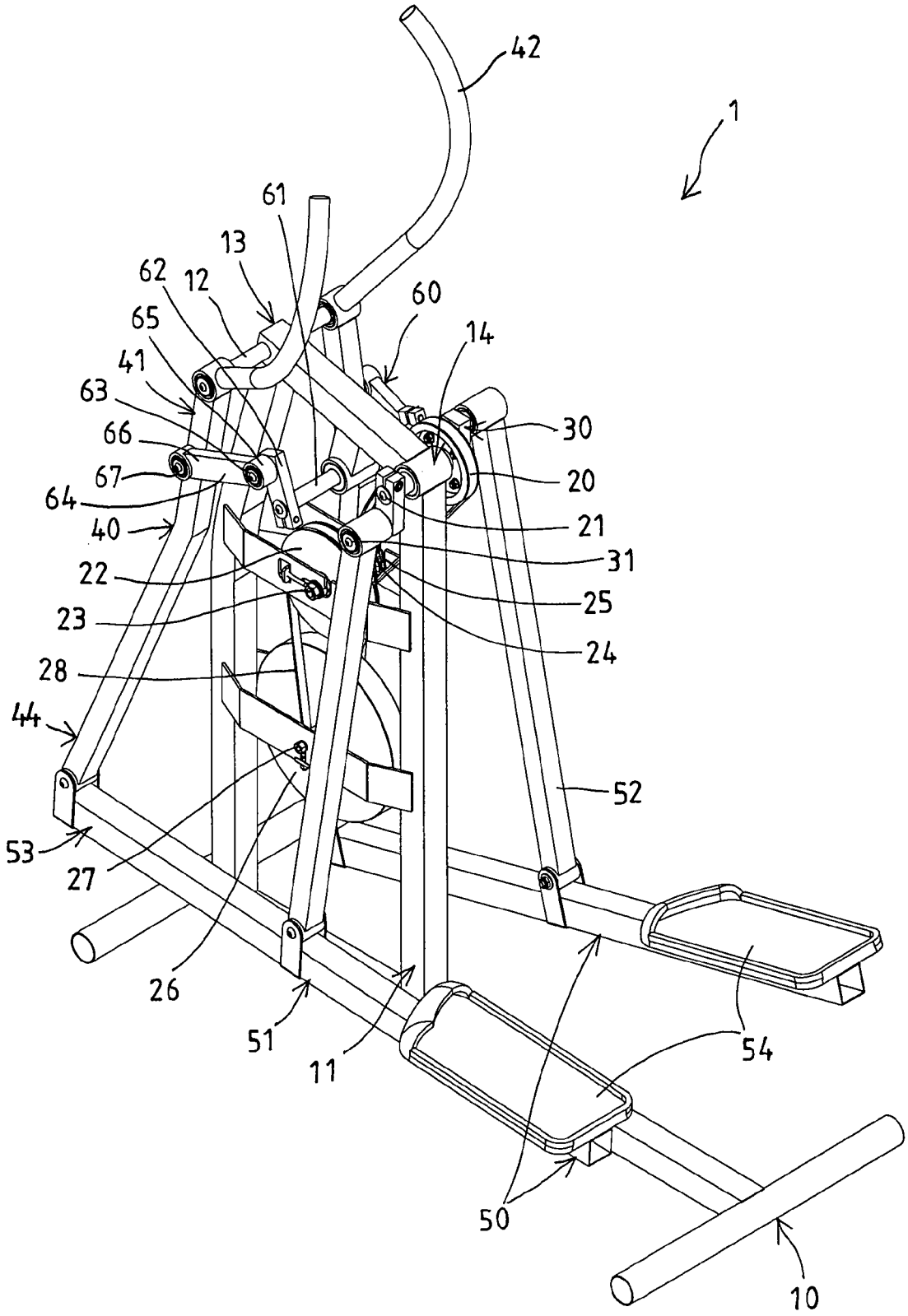
FIG. 2 is a rear perspective view of the exercise device.
Figure 3:
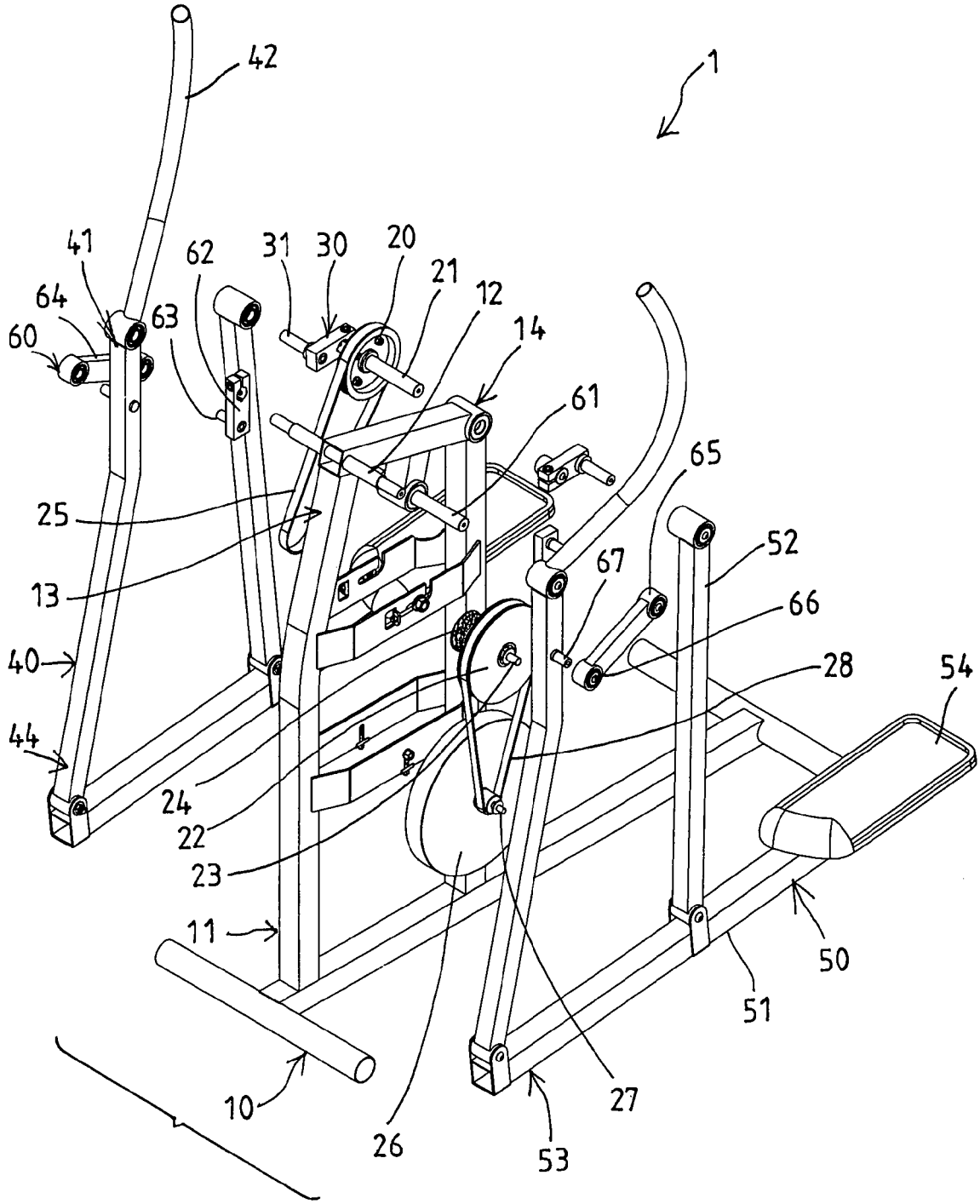
FIG. 3 is a partial exploded view of the exercise device as seen from the front portion of the exercise device.
Figure 4:
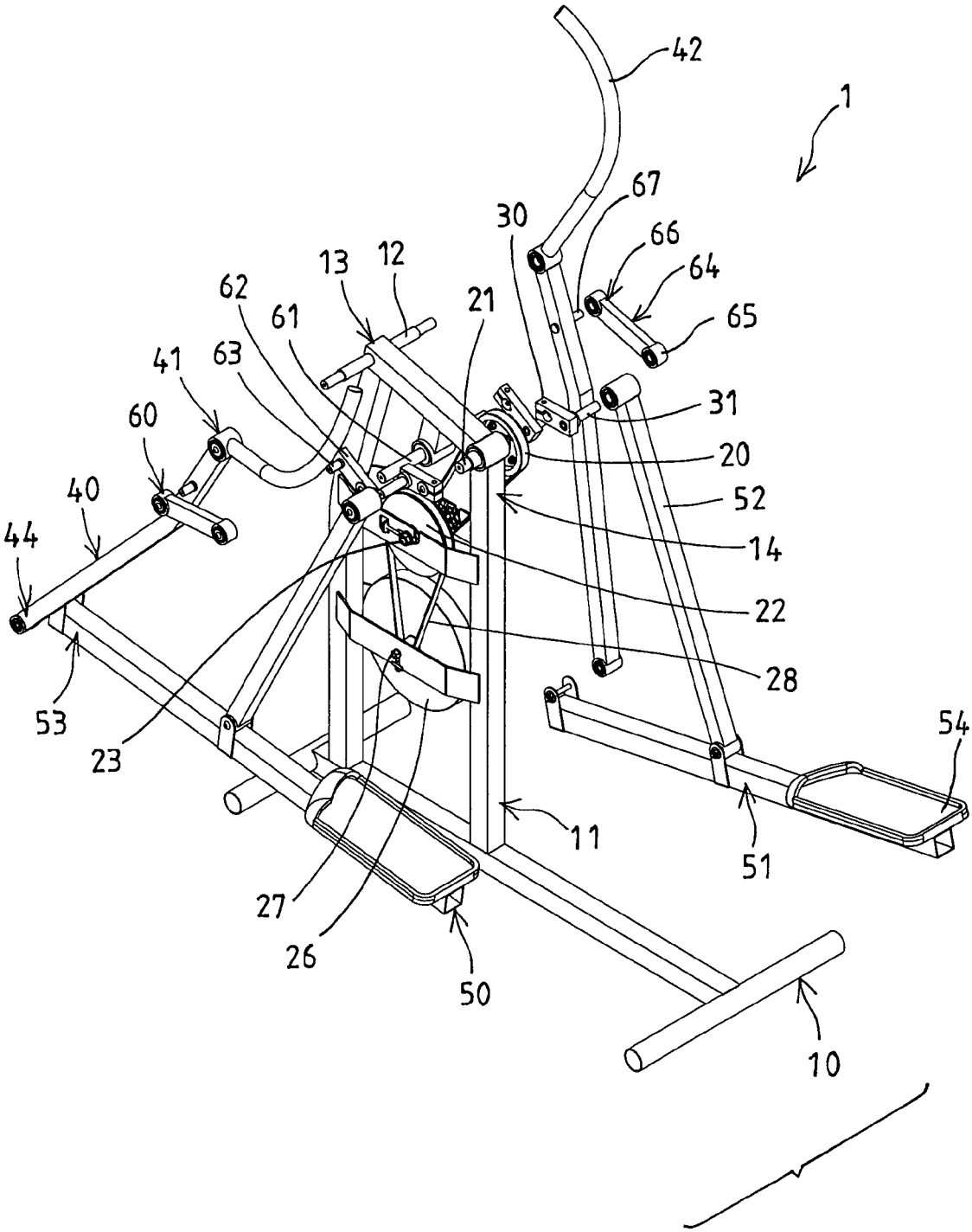
FIG. 4 is a partial exploded view of the exercise device as seen from the rear portion of the exercise device.
Figure 5:
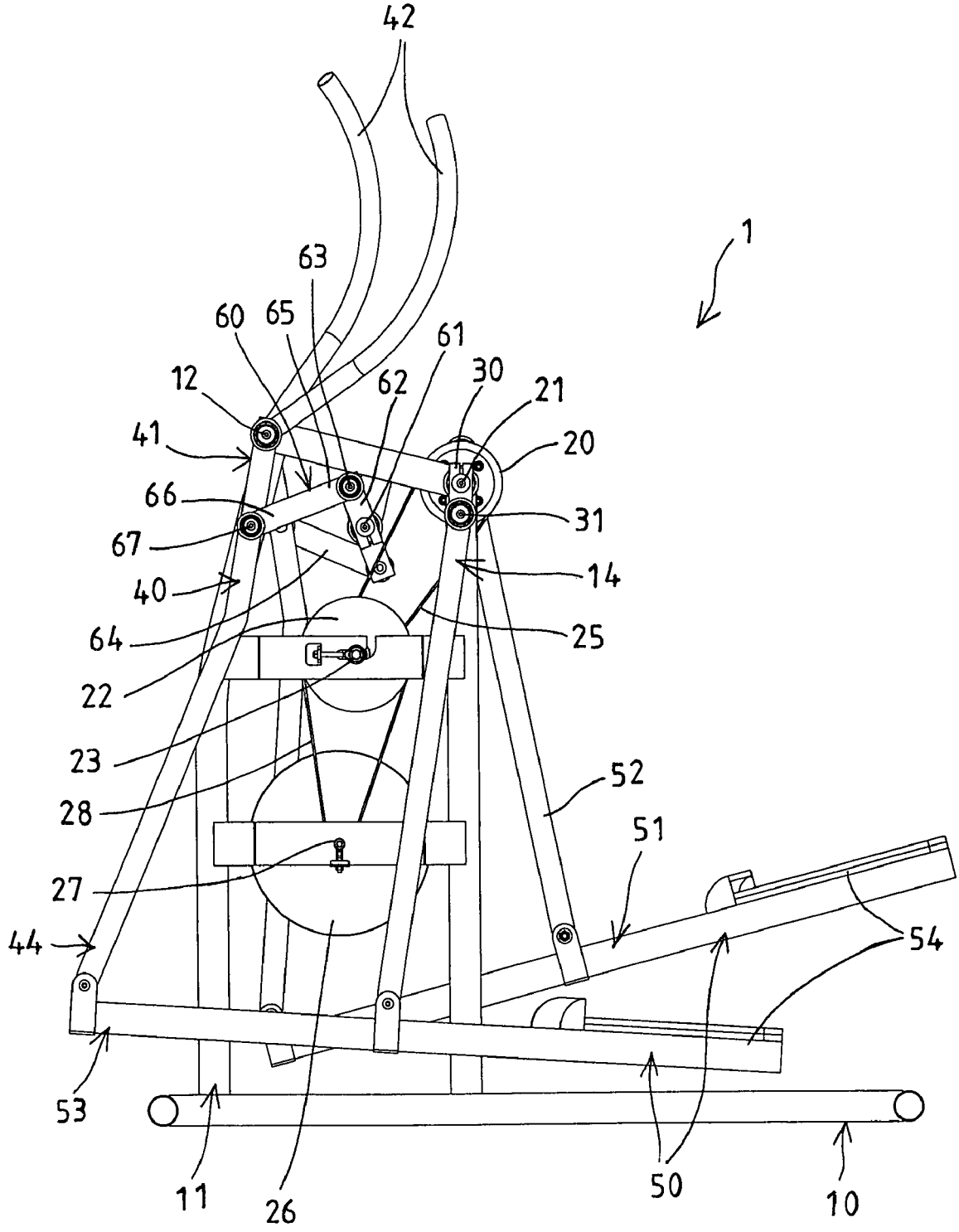
FIG. 5 is a side plan schematic view of the exercise device.

Referring to the drawings, and initially to FIGS. 1-5, an exercise device 1 in accordance with the present invention comprises a base 10, an upright support 11 extended upwardly from the base 10, a spindle 12 disposed or provided on the front portion 13 of the upright support 11, a rotary member or pulley or wheel 20 rotatably attached to the rear portion 14 of the upright support 11 with a shaft 21, another wheel or pulley or rotary member 22 rotatably attached to the middle portion of the upright support 11 with an axle 23, a further wheel or rotary member or pulley or follower 24 attached or secured to the axle 23 and moved in concert with the axle 23, and the follower 24 is coupled to the wheel 20 with a coupling device 25, such as a sprocket-and-chain coupling device or a gearing coupling device (not shown), or a belt 25 for allowing the follower 24 and the rotary member 22 to be rotated or driven by the wheel 20.

A weight or flywheel 26 may further be provided and attached to the middle or lower portion of the upright support 11 with a pivot rod 27 which is coupled to the rotary member 22 with another coupling device 28, such as a sprocket-and-chain coupling device or a gearing coupling device (not shown), or a belt 28 for allowing the flywheel 26 to be rotated or driven by the follower 24 and the rotary member 22 that are rotated or driven by the wheel 20. The follower 24 and the rotary member 22 and/or the flywheel 26 may apply a resistive force against the wheel 20 and the shaft 21 for resisting the rotational movement of the wheel 20 and the shaft 21. It is to be noted that the flywheel 26, the follower 24, the rotary member 22, the wheel 20 and the shaft 21 are coupled together to form a resistive means or device for resisting the rotational movement of the wheel 20 and the shaft 21, however, the other resistive device, such as the hydraulic or pneumatic resistive devices (not shown), or the magnetic retarding devices (not shown) may also be used to apply the resistive force against the wheel 20 and the shaft 21.

A pair of or two cranks 30 are secured to the shaft 21 such that the cranks 30 may be rotatably coupled to the rear portion 14 of the upright support 11 with the shaft 21, the cranks 30 each include a pivot rod 31 provided or attached thereto or extended outwardly therefrom and spaced away from or distal to the shaft 21, a pair of or two handles 40 include an upper or middle portion 41 attached or secured to the spindle 12 for allowing the handles 40 to be pivotally coupled to the front portion 13 of the upright support 11 with the spindle 12 and for allowing the handles 40 to be pivoted or swung relative to the upright support 11 of the base 10. The handles 40 each include a hand grip 42 formed or provided on the upper portion thereof for being grasped or held or operated by the users.

A pair of or two foot supports 50 each include a middle portion 51 pivotally coupled to the pivot rod 31 of the cranks 30 with a link 52 for allowing the middle portions 51 of the foot supports 50 to be moved cyclically relative to the upright support 11 of the base 10 by the cranks 30, and each include a front portion 53 pivotally coupled the lower portion 44 of the handles 40 respectively for allowing the foot supports 50 and the handles 40 to be pivotally coupled or attached to the upright support 11 of the base 10, and for allowing the foot supports 50 and the handles 40 to be moved or pivoted or swung relative to the upright support 11 of the base 10. The foot supports 50 each include a foot pedal 54 disposed or provided on the rear portion thereof for supporting the feet of the users and for allowing the feet of the users to step and to operate or to actuate the foot supports 50.

Figure 6:
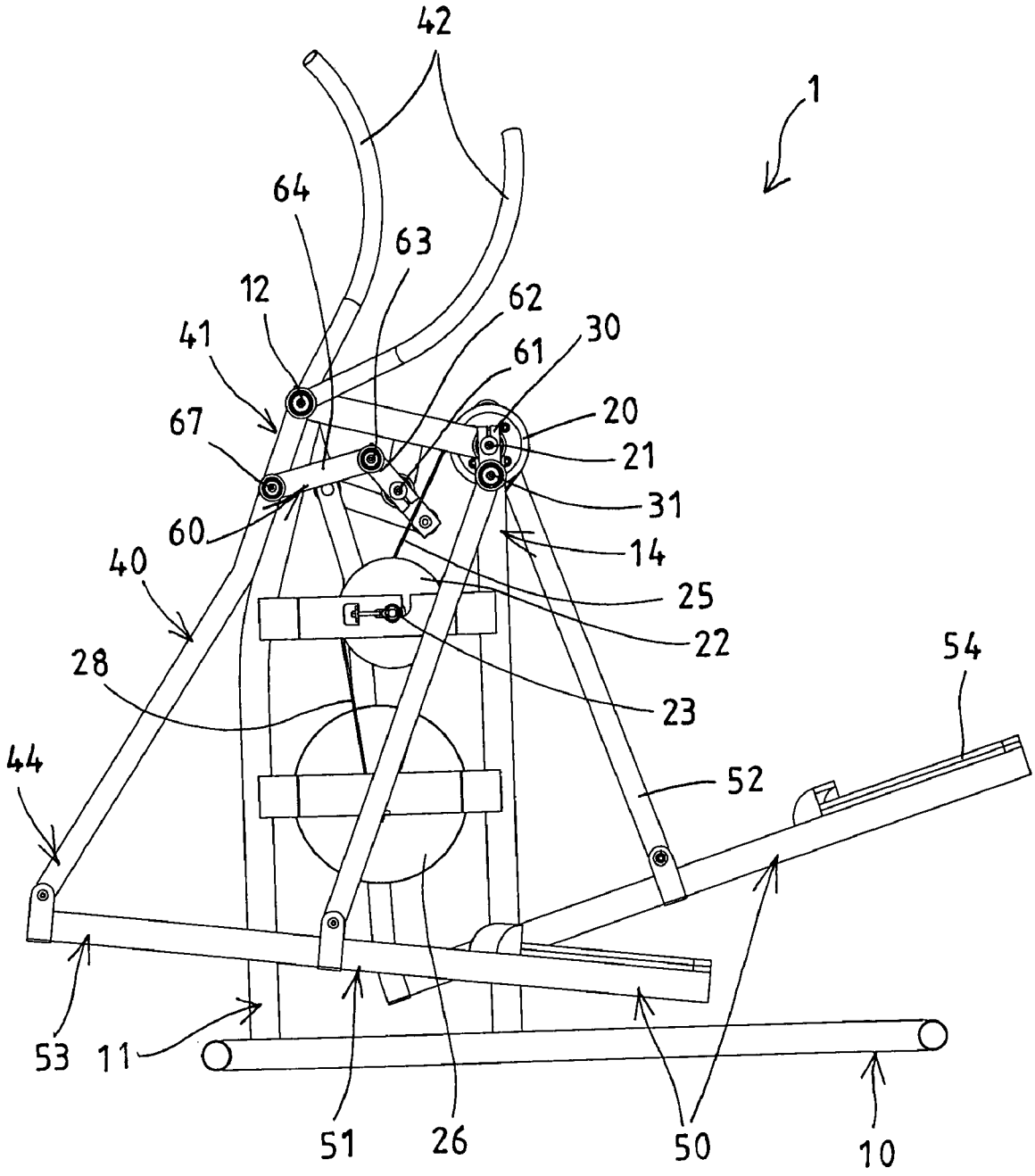
FIGS. 6, 7 are side plan schematic views similar to FIG. 5, illustrating the operation of the exercise device.
Figure 7:
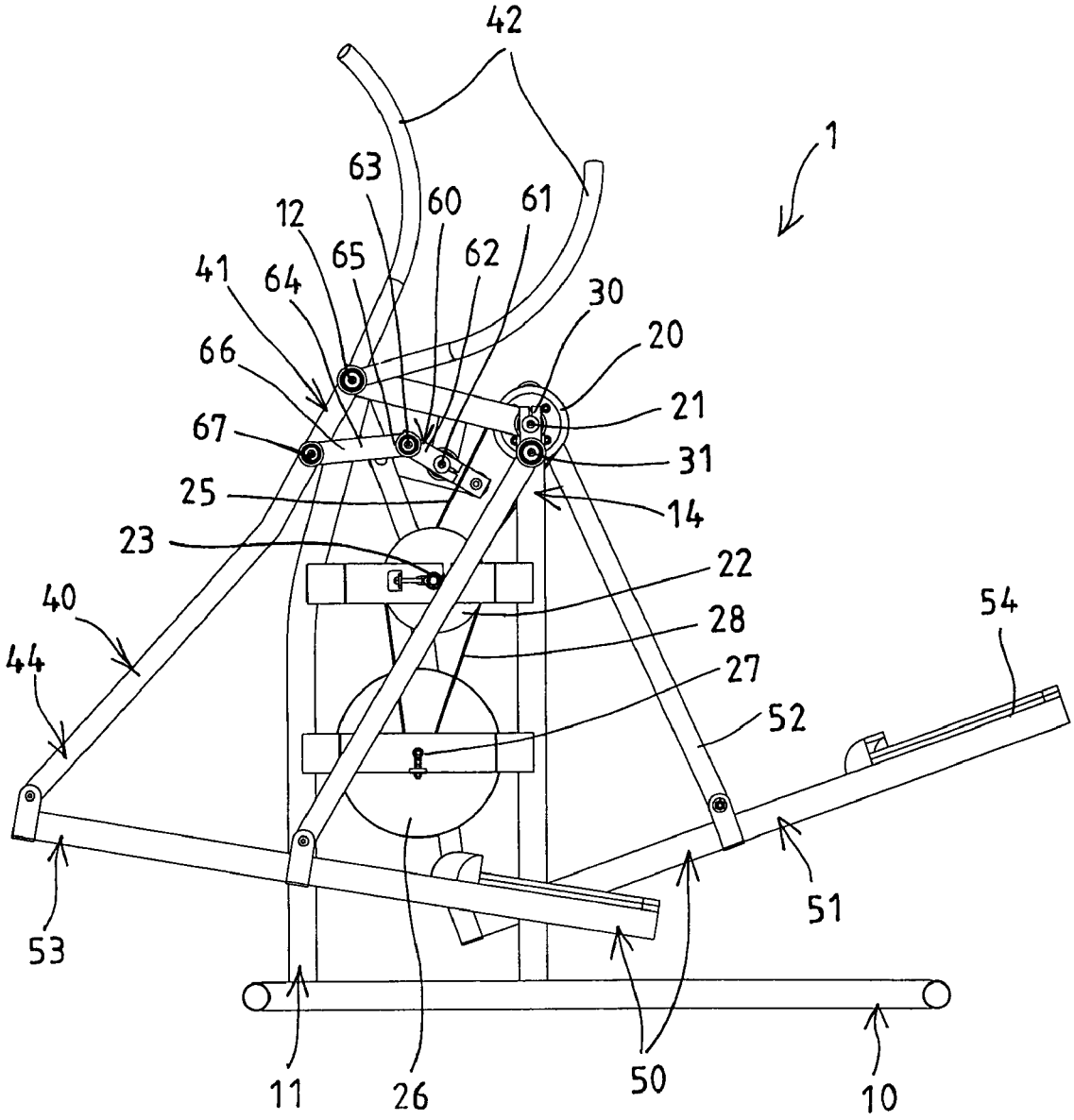

In operation, the handles 40 and the front portion 53 of the foot supports 50 may pivoted or swung relative to the upright support 11 of the base 10 with the spindle 12 of the upright support 11, and the middle portions 51 of the foot supports 50 may be moved cyclically relative to the upright support 11 of the base 10 by the cranks 30, such that the foot pedals 54 of the foot supports 50 may be moved elliptically relative to the upright support 11 of the base 10. It is to be noted that the handles 40 and thus the front portion 53 of the foot supports 50 may be solidly or stably held in place by the users with the hand grips 42 for allowing only the foot supports 50 to be stepped and actuated or worked as a stepping exerciser. In addition, the swinging movement or the moving stroke of the handles 40 may be controlled by the users in order to control and to determine the moving stroke of the foot supports 50, as shown in FIGS. 5-11.

It is preferable, but not necessarily that a coupling device 60 is further provided for coupling the handles 40 together, and the coupling device 60 includes a pivot pole 61 rotatably attached to the upright support 11, such as rotatably attached to the upper or middle portion of the upright support 11, and a pair of or two cranks 62 are secured to the pivot pole 61 such that the cranks 62 may be rotatably coupled to the upright support 11 with the pivot pole 61, the cranks 62 each include a pivot rod 63 provided or attached thereto or extended outwardly therefrom and spaced away from or distal to the pivot pole 61, and a pair of or two arms or levers 64 may further be provided and each include one end or first end or rear portion 65 pivotally coupled to the pivot rod 63 of the cranks 62, and each include the other end or second end or front portion 66 pivotally coupled to the middle portions 41 of the handles 40 with a fastener or securing device or pivot pin 67 which is spaced away from the spindle 12, for allowing the handles 40 to be coupled together.

The provision and the coupling of the wheel 20, and the rotary member 22, and the follower 24, and the flywheel 26 may be formed or acted as a resisting means or device for applying a resistive force or a retarding force against the wheel 20 and the shaft 21 and thus the cranks 30 and the link 52 and the foot supports 50 and the levers 32 and the handles 40, and thus for resisting the rotational movement of the wheel 20 and the shaft 21 and the cranks 30 and also for resisting the swinging movement of the link 52 and the handles 40. A magnetic retarding device (not shown) may further be provided and coupled to the wheel 20 and/or the rotary member 22 and/or the follower 24 and/or the flywheel 26 for further applying a resistive force against the wheel 20 and/or the rotary member 22 and/or the follower 24 and/or the flywheel 26 and for further resisting the swinging movement of the link 52 and the handles 40.

It is to be noted that the handles 40 each include a lower portion 44 pivotally coupled the front portion 53 of the foot supports 50 for allowing the movement of the front portion 53 of the foot supports 50 and/or the moving stroke of the foot supports 50 to be controlled by the users with the handles 40 and for allowing the users to freely and selectively conduct the stepping exercises and/or elliptical exercises without adjusting any mechanism or parts or elements; i.e., the foot supports 50 may be freely and selectively conduct the stepping exercises and/or elliptical exercises while actuating or operating the foot supports 50 of the exercise device 1 without stopping the exercise device 1, and the moving strokes of the foot supports 50 may thus be determined or changed or controlled with the handles 40.

Accordingly, the exercise device in accordance with the present invention includes an arrangement for allowing the exercise device to have an increased or different moving stroke and/or a changing moving stroke, and for allowing the exercise device to be actuated or worked either as a stepping exerciser or an elliptical exerciser.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. An exercise device comprising:

a base including an upright support extended upwardly from said base and including a front portion and a rear portion, a spindle disposed on said front portion of said upright support, two first cranks rotatably coupled to said rear portion of said upright support with a shaft, said spindle being spaced from said shaft and located in front of said shaft and said first cranks, said first cranks each including a pivot rod attached to said first crank and spaced away from said shaft, a wheel rotatably attached to said rear portion of said upright support with said shaft, a rotary member rotatably attached to said uptight support with an axle and coupled to said wheel, a flywheel rotatably attached to said upright support with a pivot rod and coupled to said rotary member for resisting a rotational movement of said shaft and said first cranks, a pivot pole disposed on said upright support, two handles including a middle portion attached to said spindle for allowing said handles to be pivotally coupled to said front portion of said upright support with said spindle and for allowing said handles to be pivoted and swung relative to said upright support of said base, said handles each including a hand grip provided on an upper portion for being grasped or held by a user and each including a lower portion, two foot supports each including a front portion pivotally coupled to said lower portion of said handles, and each including a foot pedal disposed on a rear portion for supporting said user's feet, and each including a middle portion pivotally coupled to said pivot rod of said first cranks with a link for allowing said middle portions of said foot supports to be moved cyclically relative to said upright support of said base by said first cranks, said front portions of said foot supports being controlled by said handles to allow said foot supports to be actuated as a stepping exerciser when said handles and said front portions of said foot supports are stably held in place by the user with said hand grips, and to allow said foot supports to be actuated as an elliptical exerciser when said handles and said front portions of said foot supports are moved or swung by the user, wherein said stepping exerciser provides a primarily vertical stride to said pedals and said elliptical exerciser provides an elliptical stride to said pedals, and two second cranks coupled together to said pivot pole and coupled to said handles respectively for coupling said handles together.

* * * * *